United States Patent [19]

Kriegel

[11] Patent Number: 4,641,460

[45] Date of Patent: Feb. 10, 1987

[54] SEMI-MANUALLY OPERATED SERVICE WINDOW

[75] Inventor: Carl P. Kriegel, Houston, Tex.

[73] Assignee: M.C.E. Window, Inc., Houston, Tex.

[21] Appl. No.: 878,293

[22] Filed: Jun. 24, 1986

[51] Int. Cl.[4] ..... E05C 7/06

[52] U.S. Cl. ..... 49/115; 49/104; 49/333

[58] Field of Search ..... 49/333, 338, 115, 114

[56] References Cited

U.S. PATENT DOCUMENTS 3,206,187 9/1965 Cagley ..... 49/115 X
4,411,102 10/1983 Radek .
4,442,630 4/1984 Radek .

FOREIGN PATENT DOCUMENTS 1046481 10/1966 United Kingdom ..... 49/115

*Primary Examiner*—Kenneth Downey
*Attorney, Agent, or Firm*—Arnold, White & Durkee

[57] ABSTRACT

An access window for use in fast food establishments and other similar drive-thru business establishments is disclosed. The window broadly comprises a semi-manually operated closing mechanism along with two planar window members. The closing mechanism employs substantially flat circumferential grooves cut into rotors located in a bottom hinge assembly. These rotors, together with a flexible elastic linkage, enable the uniform and smooth rotation of the window members from a fixed closed to a fixed open position and enable the window members to be rotated from a fixed open to a fixed closed position when either of the window members are pulled or pushed a short distance in the direction of the closed position.

22 Claims, 9 Drawing Figures

SEMI-MANUALLY OPERATED SERVICE WINDOW

BACKGROUND OF THE INVENTION

1. Field of the Invention

This invention pertains to access windows and similar equipment and more particularly to access windows for drive-through fast food service.

The invention especially relates to access windows typically installed on the side of a building adjacent a driveway to facilitate business transactions between a clerk and a customer. The most common use of such windows is for fast-food drive-in establishments.

In a typical commercial environment a drive-in access window must easily permit the clerk to transact business with a customer and yet provide the necessary isolation between the outside environment and the inside environment to satisfy health code requirements.

2. Brief Description of the Prior Art

Prior art access windows typically employ rigid inflexible members on the window openers such as those illustrated and described in U.S. Pat. No. 4,411,102. The windows may be actuated solely by manual force or by electrical motors triggered by such force. In both cases, however, the mechanisms involved rely on mechanisms which transmit forces with essentially no give or flexibility.

The prior art also describes an attempt to employ rigid members in combination with a rubber-toothed transmission belt. An example of such a system is described in U.S. Pat. No. 4,442,630.

The manually-operated service windows depicted in the prior art referred to above typically make use of a plunger head with limited surface area for contact by a human operator. The use of such a plunger head in combination with other mechanical aspects of the prior art has resulted in a window which requires substantial force to open, and which requires a significant amount of force to retain it in the open position. In the case of a purely mechanical system, the window requires considerable effort on the part of a clerk to open a window and keep it open.

SUMMARY OF THE INVENTION

The present invention meets the above-mentioned disadvantages by providing an access window which employs a mechanism which enables a window to be opened smoothly without the need of electrical power. The invention is further characterized by a mechanism which enables the window to be returned to a closed position when the window is pulled a short distance toward the closed position.

A preferred embodiment of the apparatus comprises a pair of hinged windows with a common unhinged midpoint where they seal against each other. The windows are hinged on vertical axes, and preferably employ an antifriction bearing at the top of each hinge and a machined rotor at the bottom of each hinge. The rotors are coupled to each other by means of an adjustable elastic coupling system.

The coupling system preferably includes a feature which provides a uniform resistance as the windows are operated between a fully closed and a fully open position. The feature in a preferred form employs a spring attached at each end to elastic bands which are attached to a circumferential groove or cam surface cut into each of the rotors.

In addition to enabling the windows to be smoothly rotated from a fixed closed position to a fixed open position, the apparatus of this preferred coupling system enables the windows to be returned from a fixed open position to a fixed closed position when either of the windows is pulled a short distance toward the closed position.

In a preferred embodiment of this apparatus, circumferential grooves are machined out of each rotor. Two grooves are cut into each rotor near the upper end of the rotor and two grooves are cut into each rotor near the lower end of the rotor. The grooves accommodate a pair of flexible bands that are attached to the rotors. One band attaches each rotor to a bias member, such as a spring. The other band may attach each rotor to an extension device. The tensile force that the extension device applies against the rotors is directed in the rotational direction opposite the direction of the tensile force that the bias member applies against the rotors. Manipulation of the extension device may increase or decrease the tension of the flexible bands.

In this embodiment, the window may attain fixed closed and fixed open positions. When in the closed position, the flexible bands are seated in a pair of flat positions, but are not seated in one of the rotor's grooves. In this closed position, the bands are in their least stretched position. As the window is rotated toward its fixed open position, the bands are stretched until they become seated in a different pair of flat positions, one of these positions corresponding to the location of the previously unoccupied groove.

The windows attain a fixed open position when the friction exerted by the previously unoccupied groove and the region of the rotor lying between this groove and the other groove, lying in the same horizontal plane as the previously unoccupied groove, more than counterbalances the oppositely directed tensile force that the bias member exerts against the rotor. The difference between the frictional force that the rotor surfaces exert against the flexible bands does not need to be much greater than the oppositely directed force that the bias member exerts against the bands to enable the windows to remain open.

To rotate the windows from their fixed open to their fixed closed position, the window must be moved toward the closed position only far enough to enable the force exerted by the bias member to exceed the frictional force that the rotor surfaces exert. Since the difference in these forces may be small, pulling the window a short distance toward the closed position may cause the bias member force to exceed the frictional force, causing the window to swing to its closed position.

This preferred embodiment's flexible linkage and rotor design provide a uniform resistance when the window is rotated from its closed position to its open position, and enables a relatively short movement of the window from its fixed open position toward its closed position to cause the window to move from its open to its closed position. Since employees in fast-food drive-in establishments must complete business transactions quickly, this access window design, enabling one to close the window with a quick short pulling or pushing motion, is particularly desirable for this type of establishment.

The various features and principles of the invention will become obvious to those skilled in the art upon review of the detailed description in conjunction with the appended drawings and claims.

DESCRIPTION OF THE PREFERRED EMBODIMENTS

Figure 1:
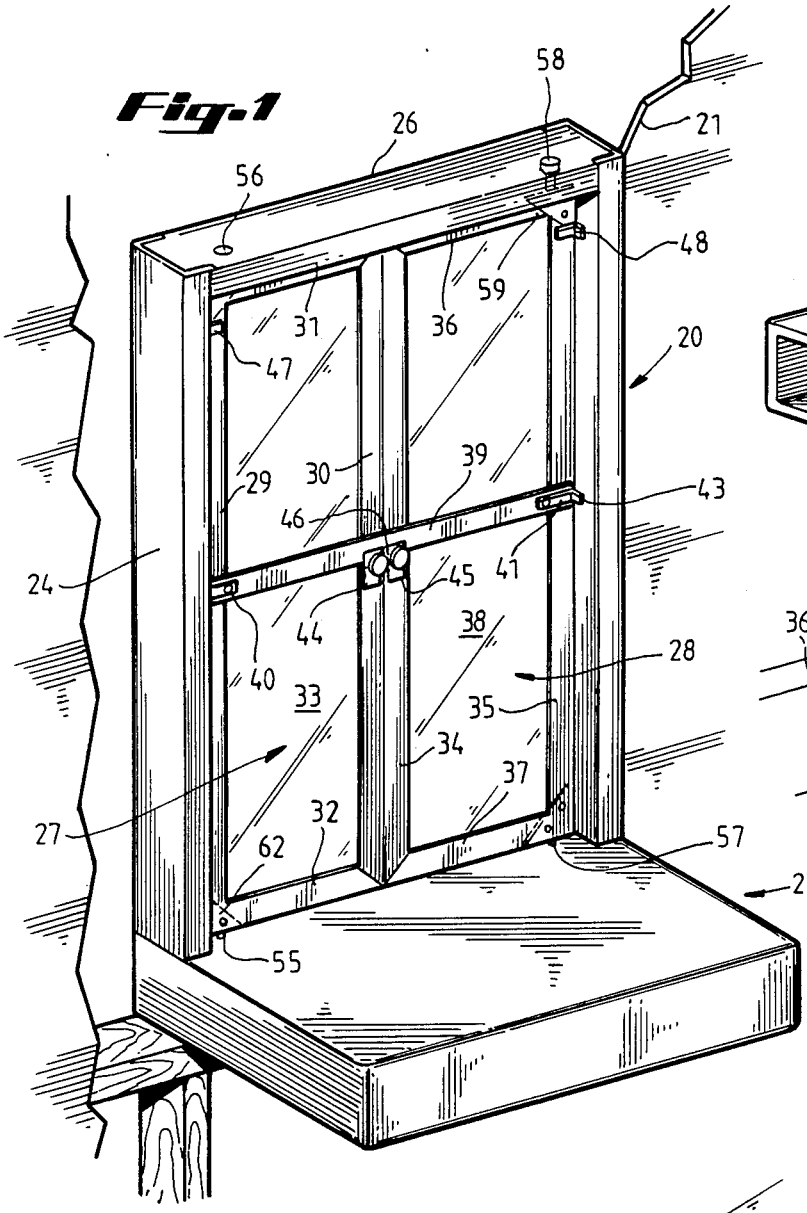
FIG. 1 is a perspective view of one embodiment of an access service window located in a wall.

FIG. 1 illustrates an access window 20 attached to a wall 21. Very broadly, the external components of the window include the horizontal service shelf 23, the vertical access window frame members 24 and 25, the top horizontal access window frame member 26, left pivoting or swinging window member 27, and right pivoting or swinging window member 28. FIG. 1 illustrates window 20 from inside the room or structure in which the window is installed.

Left swinging planar surface or window member 27 comprises a frame with vertical frame members 29 and 30, top frame member 31 and bottom frame member 32. Frame members 29, 30, 31, 32 describe the outer perimeter of a window pane 33 which in the preferred embodiment is glass.

In a similar manner right swinging planar surface or window member 28 comprises vertical frame members 34 and 35, top frame member 36 and bottom frame member 37. Frame members 34, 35, 36 and 37 likewise form the outer perimeter of window pane 38.

In a preferred embodiment of the present invention frame members 29 and 31 are joined together by mitered joints at 45° angles. Similarly, adjacent frame members are likewise joined by mitered joints.

Vertical frame members 29 and 35 provide for offset vertical swinging axes of window members 27 and 28, respectively. In a preferred embodiment window members 27 and 28 swing outward pivoting about their vertical swinging axes. The window members 27 and 28 meet at the access window centerline, as vertical frame members 30 and 34 come into contact when the window is closed.

Alternatively, window members 27 and 28 may be configured to swing inward pivoting about the same vertical swinging axes.

Also illustrated in FIG. 1 is a horizontal window latching bar 39, sliding latch mechanisms 40 and 41 and latching bar slots 44 and 45. Latching bar 39 is used to latch or lock the access window in the closed position. To latch the window in the closed position horizontal bar 39 is first placed in latch bar slots 44 and 45. Sliding latch bars 40 and 41 are then slid outward into suitable slots, holes or like receptacles 42 (not shown) and 43. Two knobs 46 are attached to latch bar slots 44 and 45. The knobs 46 may be bolted or screwed onto the latch bar slots 44 and 45 and facilitate the easy opening and closing of window members 27 and 28.

Stops 47 and 48 prevent window members 27 and 28 from swinging inward past the plane defined by access window frame members 24 and 25. In an embodiment in which window members 27 and 28 are configured to swing inward, stops 47 and 48 may be screwed or bolted into frame members 24 and 25 on the opposite side of window members 27 and 28 to prevent window members 27 and 28 from swinging outward past the plane defined by access window frame members 24 and 25.

Swinging window member 27 pivots about pivot points 55 and 56. In a similar manner right window member 28 pivots about pivot points 57 and 58. A line drawn between pivot points 55 and 56 forms an imaginary vertical pivot axis which is hereinafter referred to as the vertical pivot axis. In a preferred embodiment, the vertical pivot axis is offset from the side edge of frame members 29 and 35 as shown in FIG. 2.

Figure 2:
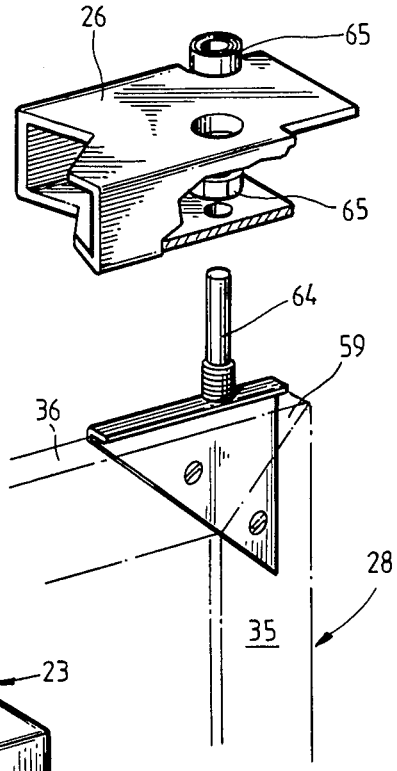
FIG. 2 is a detailed, exploded, partially cutaway perspective view of one of the top hinge posts of one of the window members.

Referring to FIG. 2, an exploded view of right swinging window member 28 illustrates the mitered joint connecting top horizontal frame member 36 to right vertical frame member 35, top window member attachment bracket 59, hinge post 64 and top window frame member 26. Window member attachment bracket 59 is attached to window frame members 35 and 36 by means of screws or other similar devices.

The hinge post 64 is attached to the window corner bracket 59 by brazing or other suitable means. The centerline of hinge post 64 is the centerline of the vertical pivot axis between pivot points 57 and 58.

Hinge post 64 is inserted through an antifriction device 65 such as a roller bearing. Hinge post 64 is held in its vertical position by means of nut 65*a* or other suitable means. Bearing 65 is retained in position by a bearing receptacle fabricated from flat bar stock or in any other suitable manner.

It is to be understood that the top of window member 27 is hinged in a manner similar to that described for window member 28.

Figure 3:
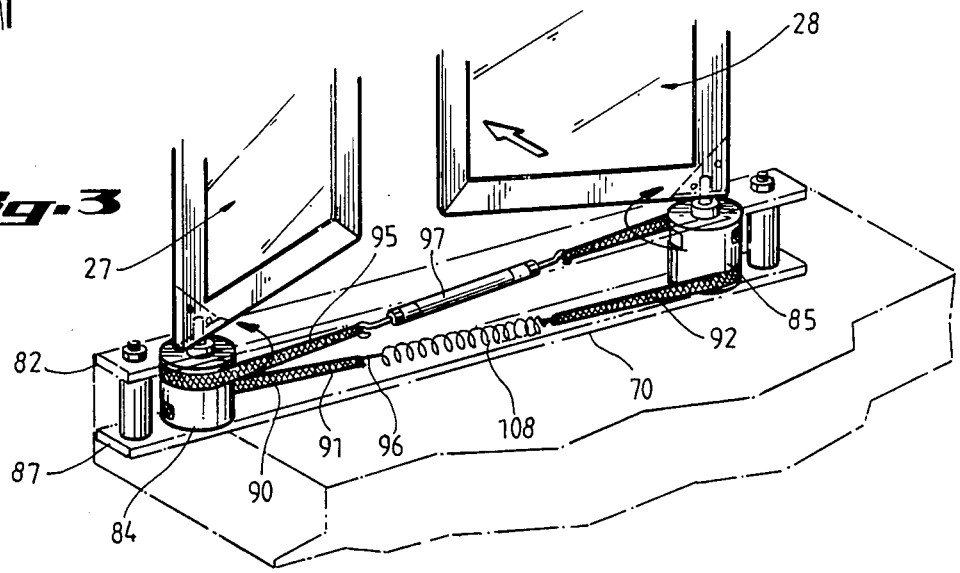
FIG. 3 is a perspective, partially phantom view of an embodiment of the semi-manually operated closing mechanism.
Figures 4, 5, 6, 7, 8, 9:
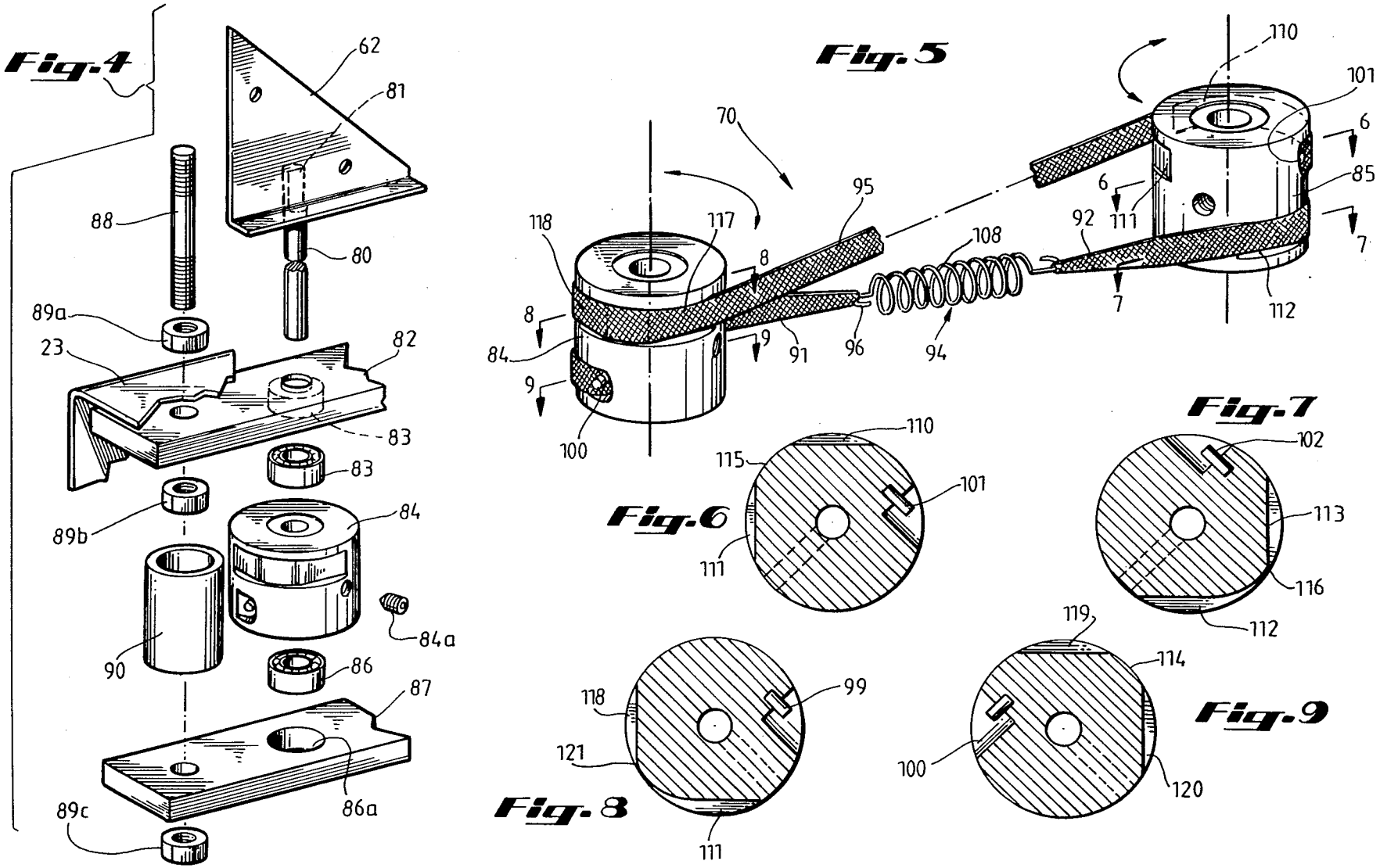
FIG. 4 is an exploded view of the bottom hinge post of one of the window members.
FIG. 5 is a partial detailed development of the access window's semi-manually operated closing mechanism.
FIG. 6 is a cutaway top view of the right access window rotor taken along line 6—6 of FIG. 5.
FIG. 7 is a cutaway top view of one of the access window rotors taken along line 7—7 of FIG. 5.
FIG. 8 is a cutaway top view of the left access window rotor taken along line 8—8 of FIG. 5.
FIG. 9 is a cutaway top view of the left access window rotor taken along line 9—9 of FIG. 5.

Referring to FIG. 3, the general method of the apparatus' operation is illustrated. Window members 27 and 28 are connected to a semi-manually operated closing mechanism 70. As the window members 27 and 28 are pushed open in the outward direction (see arrow), rotors 84 and 85 (connected to window members 27 and 28 as shown in FIG. 4) begin to rotate. Rotor 84 rotates in the counterclockwise direction and rotor 85 in the clockwise direction (see arrows). Rotors 84 and 85 rest between brackets 82 and 87.

Different portions of counter rotation links 95 and 96 release from or engage to rotors 84 and 85 during the rotation. As rotor 84 rotates, portions of counter rotation link 95 release from rotor 84 and portions of counter rotation link 96 engage to rotor 84. As rotor 85 rotates, portions of counter rotation link 95 engage to rotor 85 and portions of rotation link 96 release from rotor 85.

Spring 108 and turnbuckle 97 maintain tension on counter rotation links 95 and 96. Adjusting turnbuckle 97 to a shorter length increases the tension exerted on counter rotation links 95 and 96. Varying the strength of spring 108 increases or decreases the tension exerted on counter rotation links 95 and 96.

As is shown in the description of FIGS. 5–9 below, the interaction between the semi-manually operated closing mechanism 70, including a preferred design for rotors 84 and 85, and window members 27 and 28 enables window members 27 and 28 to be uniformly rotated from a fixed closed position to a fixed open position. Further, this apparatus enables window members 27 and 28 to be rotated from a fixed open position to a fixed closed position by pulling window members 27 and 28 a relatively short distance toward the fixed closed position. As is further shown in the description of FIGS. 5–9 below, after window members 27 and 28 are pulled a short distance toward the fixed closed position, the force that spring 108 exerts upon flexible bands 91 and 92 will pull window members 27 and 28 into the fixed closed position.

Referring to FIG. 4, the lower hinge of window member 27 is illustrated in detail; the lower hinge for window member 28 is similar.

Left window bottom corner bracket 62 is attached to the vertical frame member 29 and horizontal frame member 32 using screws or other suitable means. The top end 81 of hinge post 80 is attached to corner bracket 62 by means of brazing or other suitable means.

Hinge post 80 is inserted through horizontal shelf 23, bracket 82, an upper antifriction member 83, rotor 84 and a lower antifriction member 86. Antifriction member 83 in a preferred embodiment is a roller bearing which is inserted in a bearing receptacle 83*a* machined out of bracket 82. In a similar manner, bearing receptacle 86*a* for bearing 86 is machined out of lower bracket 87. The lower hinge assembly is held together by means of threaded stud 88, nuts 89*a* and 89*b*, spacer 90 and nut 89*c*. Spacer 90 is interdisposed between brackets 82 and 87 to prevent the compressive forces of nuts 89*a* and 89*c* from interfering with the rotation of rotor 84.

Brackets 82 and 87 are mounted below shelf 23 and are held in place by securing brackets 82 and 87 to shelf 23 by means of threaded stud 88, nuts 89*a*, 89*b*, spacer 90 and nut 89*c*. Threaded stud 88 is long enough to protrude through horizontal shelf 23 to secure window frame member 24 in the vertical position.

Rotor 84 is attached to hinge post 80 by means of set screw 84*a*. Set screw 84*a* is screwed into hinge post 80. Rotor 85 is attached to its respective hinge post in a similar manner.

Various aspects of rotors 84 and 85 and of the elastic and flexible linkage which interconnects window rotors 84 and 85 are illustrated in FIGS. 5 through 9.

As shown in FIG. 5, rotors 84 and 85 are interconnected by means of a flexible linkage 94. Flexible and elastic linkage 94 comprises counter rotation links 95 and 96. Counter rotation link 95 is wrapped around the backside of rotor 85 and around the front side of rotor 84. In a similar manner counter rotation link 96 is wrapped around the backside of rotor 84 and around the front side of rotor 85. The counter rotation links 95 and 96 cause rotor 84 to rotate in a counterclockwise direction, whenever rotor 85 rotates in a clockwise direction. They further cause rotor 84 to rotate in a clockwise direction, whenever rotor 85 rotates in a counterclockwise direction. Equal and equidistant rotation is accomplished by adjusting turnbuckle 97 (see FIG. 3). Turnbuckle 97 may be adjusted in a manner such that the length of interconnecting link 95 is equal to the length of interconnecting link 96 and may be adjusted to increase or decrease the tension exerted upon interconnecting link 95. Further, turnbuckle 97 adjustment enables window members 27 and 28 to be centered when they are closed.

In a preferred embodiment, interconnecting linkages 95 and 96 are constructed of 10 strands of 80 lb. No. 9 nylon fishing line. The 10 strands are woven on a loom into a flat band. The flat band in the preferred embodiment is very pliable and flexible and provides a significant number of window operations without breakage and without deterioration of adjustment or operation.

Counter rotation link 95 is anchored to rotor 84 at anchor point 99 (shown in FIG. 8). Link 95 may be anchored at anchor point 99 by forming a loop in the end of link 95 and slipping the loop over anchor point 99, or it may be attached by some other similar means. Counter rotation link 96 is anchored to rotor 84 at anchor point 100. Counter rotation links 95 and 96 are anchored to rotor 85 in a similar fashion at anchor points 101 and 102 (see FIGS. 6 and 7), respectively. The counter rotation links 95 and 96 rotate about the outer peripheries of rotors 84 and 85.

FIG. 6 is a cutaway top view of rotor 85 taken along line 6—6 of FIG. 5. FIG. 6 shows that axially spaced grooves 110 and 111 have been machined out of rotor 85. In addition, anchor point 101 for counter rotation link 95 is shown. Further, a rounded region or apex 115 that lies between grooves 110 and 111 is shown.

FIG. 7 is a cutaway top view of rotor 85 taken along line 7—7 of FIG. 5. FIG. 7 shows that grooves 112 and 113 have been machined out of rotor 85. In addition, anchor point 102 for counter rotation link 96 is shown, as is point or apex 116, at which groove 112 meets groove 113.

FIG. 8 is a cutaway top view of rotor 84 taken along line 8—8 of FIG. 5. FIG. 8 shows that grooves 117 and 118 have been machined out of rotor 84. In addition, anchor point 99 for counter rotation link 95 is shown, as is point or apex 121, at which groove 117 meets groove 118.

FIG. 9 is a cutaway top view of rotor 84 taken along line 9—9 of FIG. 5. FIG. 9 shows that grooves 119 and 120 have been machined out of rotor 84. In addition, anchor point 100 for counter rotation link 96 is shown, as is rounded region or apex 114 that lies between grooves 119 and 120.

As is shown in FIGS. 6–9, the top portion of rotor 85 and the lower portion of rotor 84 are shaped like uniform motion or straight line cams. The lower portion of rotor 85 and the upper portion of rotor 84 are shaped like modified straight line or modified uniform motion cams.

The width of groove 110 is slightly greater than the width of groove 111, as shown in FIG. 6. Likewise, the width of groove 119 is slightly greater than the width of groove 120, as shown in FIG. 9. In addition, the widest portion of groove 112 has a greater width than the width of any part of groove 113 and the widest portion of groove 117 has a greater width than the width of any part of groove 118.

As shown in FIG. 5, counter rotation link 96 is seated in groove 112 and groove 113 (not shown). FIG. 5 shows that when counter rotation link 96 is seated in grooves 112 and 113, counter rotation link 95 is seated in groove 110, but is not seated in groove 111. As rotor 85 is rotated clockwise, counter rotation link 96 will gradually release from groove 112, and counter rotation link 95 will begin to engage groove 111. Eventually, after about a 90° rotation of rotors 84 and 85 from the position shown in FIG. 5, counter rotation link 96 will have released completely from groove 112 and be seated only in groove 113. Likewise, counter rotation link 95 will have become seated in both grooves 110 and 111 and be in contact with peripheral region 115.

Grooves 117 and 118 (as shown in FIGS. 5 and 8), corresponding to grooves 112 and 113 (as shown in FIG. 7), are machined out of rotor 84. Grooves 119 and 120 (shown in FIG. 9) are machined out of rotor 84 and correspond to grooves 110 and 111 (as shown in FIG. 6). Thus, the vertical placement of the grooves corresponding to grooves 110, 111, 112 and 113 machined out of rotor 85, has been reversed for rotor 84. In rotor 84 grooves 117 and 118, shaped like grooves 112 and 113, respectively, are placed in the upper part of rotor 84, whereas these grooves are placed in the lower part of rotor 85. In addition, grooves 119 and 120, shaped like grooves 110 and 111, respectively, are placed in the lower part of rotor 84, whereas these grooves are placed in the upper part of rotor 85. As a result, rotor 84 is essentially rotor 85 turned upside down.

FIG. 5 shows the semi-manually operated closing mechanism 70 in the position corresponding to the closed position of window members 27 and 28, as shown in FIG. 1.

When window members 27 and 28 are in this closed position, counter rotation link 96 is seated in grooves 112 and 113 of rotor 85, and counter rotation link 95 is seated in groove 110 of rotor 85, but is not in contact with groove 111. Concerning rotor 84, counter rotation link 96 is seated in groove 119, but is not seated in groove 120, and counter rotation link 95 is seated in grooves 117 and 118.

Because the widths of grooves 110, 112, 117 and 119 are respectively greater than the widths of grooves 111, 113, 118 and 120, the flexible linkage 94 is in its least stretched position when the semi-manually operated mechanism 70 is in the position shown in FIG. 5, corresponding to the closed position of window members 27 and 28, as shown in FIG. 1.

As window members 27 and 28 are rotated toward the open position, as shown in FIG. 3, counter rotational link 96 begins to release from groove 112 in rotor 85 and begins to engage groove 120 in rotor 84. In a similar fashion, as window members 27 and 28 are opened, counter rotational link 95 begins to release from groove 117 of rotor 84 and begins to engage groove 111.

As the window members 27 and 28 rotate (as shown in FIG. 3) from the closed position (as shown in FIG. 1) to the open position, flexible linkage 94 begins to stretch. Spring 108, connecting flexible bands 91 and 92, exerts a tensile force upon flexible bands 91 and 92 and therefore resists this stretching effect. The pulling force that spring 108 exerts against bands 91 and 92 will pull flexible linkage 94 back to the position shown in FIG. 5, unless the frictional force that rotors 84 and 85 exert against counter rotational links 95 and 96 counterbalances the force that spring 108 exerts on bands 91 and 92.

As counter rotational link 95 begins to engage groove 111 of rotor 85 and counter rotational link 96 begins to engage groove 120 of rotor 84, the frictional force that the surfaces of rotors 84 and 85 exert against counter rotational links 95 and 96 increases. Simultaneously, the amount of stretch in links 95 and 96 decreases, but still exceeds the stretch applied to flexible linkage 94 when linkage 94 is in the least stretched position (as shown in FIG. 5), corresponding to the closed position of window members 27 and 28 (as shown in FIG. 1).

When rotors 84 and 85 have been rotated approximately 90°, window members 27 and 28 reach their open position. When in the open position, window members 27 and 28 have rotated about 90° outward (the arrow in FIG. 3) from the closed position shown in FIG. 1.

When in the open position, counter rotational link 95 is seated in grooves 110 and 111 of rotor 85 and is seated in groove 118 of rotor 84, but is no longer engaged to groove 117 of rotor 84. In similar fashion, counter rotational link 96 is seated in grooves 119 and 120 of rotor 84, and in groove 113 of rotor 85, but is no longer engaged to groove 112 of rotor 85.

In this open position, the frictional force that groove 111 and region 115 (shown in FIG. 6) exert against link 95 and the frictional force that groove 113 exerts against link 96, together with the frictional force that groove 120, and the region 114 between groove 119 and groove 120, exert against link 96 and the frictional force that groove 118 exerts against link 95, exceeds the oppositely directed tensile force that spring 108 exerts against bands 91 and 92. Since the frictional forces that the surfaces of rotors 84 and 85 exert against links 95 and 96 exceed the tensile force that spring 108 exerts against bands 91 and 92, once window members 27 and 28 have obtained an open position (after about a 90° rotation from the position shown in FIG. 1), window members 27 and 28 remain fixed in that position.

Before obtaining this open position, i.e., before link 95 becomes seated in groove 111 of rotor 85 and before link 96 becomes seated in groove 120, the frictional forces that the surfaces of rotors 84 and 85 exert upon links 95 and 96 may not exceed the tensile force that spring 108 exerts against links 95 and 96 and, as a consequence, spring 108 may pull rotors 84 and 85 back to the position shown in FIG. 5, corresponding to the closed position of window members 27 and 28, shown in FIG. 1.

The shape of grooves 112 and 117 helps enable the rotation of window members 27 and 28, from the closed position (shown in FIG. 1) to an open position, to be smooth and uniform. Further, the tension that spring 108 exerts upon bands 91 and 92 helps ensure this smooth and uniform rotation.

The design of the semi-manually operated closing mechanism 70 enables the rotation of window members 27 and 28 from an open to a closed position by pulling window members 27 and 28, preferably at knobs 46 shown in FIG. 1, a short distance toward the closed position.

In the embodiment shown in FIG. 5, rotors 84 and 85 act as straight line or uniform motion cams. When counter rotational links 95 and 96 are seated on one side of the cam, corresponding to being seated in grooves 110 and 119, respectively, the window is shut. When rotated to a position in which counter rotational links 95 and 96 are seated on both sides of the cam, corresponding to being seated in grooves 110 and 111 and grooves 119 and 120, respectively, the window is open. Since rotors 84 and 85 act as straight line cams, counter rotational links 95 and 96, which may be considered as being cam followers, are uniformly moved when window members 27 and 28 are rotated from the closed position shown in FIG. 5 to an open position.

The design of rotor 85, as shown in FIG. 7, allows the lower portion of rotor 85 to act as a modified straight line or modified uniform motion cam. Likewise, as shown in FIG. 8, the upper portion of rotor 84 acts as a modified straight line or modified uniform motion cam. The surface of rotor 85 corresponding to groove 112 and the surface of rotor 84 corresponding to groove 117 are smoothly tapered. This shape allows counter rotational links 96 and 95 to release from grooves 112 and 117, when window members 27 and 28 are being rotated from a closed to an open position, in a smooth rather than abrupt manner.

To close window members 27 and 28, they only need to be rotated far enough to enable the tensile force that spring 108 exerts against bands 91 and 92 to exceed the frictional forces that the surfaces of rotors 84 and 85 exert against links 95 and 96. Once window members 27 and 28 are rotated far enough to enable the tensile force that spring 108 exerts to exceed the frictional forces that the surfaces of rotors 84 and 85 exert, spring 108 will pull window members 27 and 28 into the closed position, shown in FIG. 1. In a preferred embodiment, stops 47 and 48 prevent window members 27 and 28 from being pulled inward beyond the plane defined by the inward edges of window frame members 24 and 25.

The point at which the force of spring 108 exceeds the frictional force of rotors 84 and 85 may depend upon the strength of spring 108, the adjustment of turnbuckle 97 and the relative widths of the grooves cut into rotors 84 and 85. The stronger the spring, the shorter the distance window members 27 and 28 must be pulled before spring 108 will pull window members 27 and 28 into the closed position. As turnbuckle 97 is adjusted to be shorter, the tension increases in links 95 and 96, enabling window members 27 and 28 to be pulled an even shorter distance before spring 108 will pull window members 27 and 28 into the closed position. Further, as the difference in widths between grooves 111 and 110, grooves 113 and 112, grooves 118 and 117, and grooves 120 and 119 increases, the amount of stretch increases in the flexible linkage 94, above the amount of stretch placed on flexible linkage 94 when in the least stretched position (FIG. 5). This increased stretch increases the tension exerted upon links 95 and 96 and decreases the distance that window members 27 and 28 must be pulled before spring 108 will pull window members 27 and 28 into the closed position.

In a particularly preferred embodiment of the access window, the adjustment of turnbuckle 97, strength of spring 108, and relative widths of the grooves allow rotors 84 and 85 to attain a fixed position only when links 95 and 96 become seated in grooves 118, 111, 120 and 113 respectively. In this embodiment, rotating rotors 84 and 85 a small distance causes links 95 and 96 to begin to release from grooves 118, 111, 120 and 113 allowing spring 108 to pull rotors 84 and 85 back to the position shown in FIG. 5, corresponding to the closed window position shown in FIG. 1.

In this particularly preferred embodiment of the access window, the grooves machined out of rotors 84 and 85 enable window members 27 and 28 to be opened, without rotating more than about 90° outward from their closed position. Since the grooves machined out of rotors 84 and 85 provide seats for links 95 and 96, links 95 and 96 slide into the grooves and help stop the rotation of window members 27 and 28 once rotors 84 and 85 are rotated about 90° from the closed position. An alternative method of ensuring that window members 27 and 28 do not extend beyond about 90° in the outward direction from their closed position is to place stops lying in a plane perpendicular to the plane defined by window frame members 24 and 25. These stops could be placed on the outward facing edge (not shown) of window frame members 24 and 25 (FIG. 1), and would ensure that window frame members 27 and 28 would not swing more than 90° in the outward direction from their closed position.

The access window 20 enables window members 27 and 28 to be smoothly rotated from a fixed closed position to a fixed open position. In addition, the access window 20 enables window members 27 and 28 to be rotated from a fixed open position to a fixed closed position by pulling window members 27 and 28 a relatively short distance toward the closed position.

Since window members 27 and 28 must be pulled only a short distance to enable closure of the access window 20, a short quick movement effects closure of the window. In the fast-food drive-in business, employees often have little time to open and close windows. The present invention provides an access window that is ideal for this type of establishment since it may be opened in a smooth uniform manner and may be closed with a short quick pulling motion.

As can be appreciated by one skilled in the art, the above detailed description describes only one embodiment of the present invention. The window can be readily adapted from an outwardly opening window to an inwardly opening window by merely rotating the semi-manually operated mechanism 70 180° such that rotor 84 is rotated to the position of rotor 85 in FIG. 3 and rotor 85 is rotated to the position of rotor 84. After this 180° rotation, the window members 27 and 28 will smoothly open inwardly until reaching a fixed open position. After reaching an open position, a slight push in the outward direction will enable the tensile force of the spring 108 to exceed the frictional force of the rotors 84 and 85 and enable the spring 108 to pull window members 27 and 28 into a fixed closed position in the same manner as described for the outwardly opening window. Various components may be replaced by other mechanical or electromechanical equivalents to accomplish the same result, particularly in view of the interchangeable nature of such devices and their functions in the present invention. Variations and modifications of the invention will become obvious from the drawings and specification. Accordingly, the present invention should be limited only by the scope of the appended claims.

What is claimed is:

1. An access window comprising:

(a) at least one hinged window member;

(b) a rotor member operatively coupled to said window member; and (c) a flexible linkage operatively coupling said rotor member to a fixed or rotational support such that a relatively slight rotational movement of said window member from a fixed position causes said flexible linkage and said rotor to swing said window member along a relatively long arcuate path compared to the distance covered by said slight rotational movement;

said rotor equipped with at least one circumferential groove, said groove being capable of accommodating said flexible linkage, the radial distance between the outer surface of a portion of said groove and the center of said rotor exceeding the radial distance between the outer surface of another portion of said groove and the center of said rotor.

2. The access window of claim 1 wherein said rotor is equipped with at least two axially displaced circumferential grooves, each said groove capable of accommodating said flexible linkage, and a region lying adjacent to or between said grooves in which the radial distance between the outer surface of at least a portion of said region and the center of said rotor exceeds the radial distance between the outer surface of at least a portion of each said groove and the center of said rotor.

3. The access window of claim 2 wherein the midpoint of one of said axially displaced circumferential grooves is located about 90° from the midpoint of another one of said axially displaced circumferential grooves.

4. The access window of claim 2 wherein the radial distance between the outer surface of at least a portion of one of said grooves and the center of said rotor exceeds the radial distance between the outer surface of at least a portion of another said groove or grooves and the center of said rotor.

5. An access window for installation in business establishments to provide access between a customer and a sales person comprising:

(a) at least one pivoting planar surface hinged at a minimum of two pivot points;

(b) a rotor member operatively coupled to at least one of said pivot points; and (c) a flexible linkage operatively coupling said rotor member to a fixed or rotational support such that a relatively slight rotational movement of said planar surface from a fixed position causes said flexible linkage and said rotor to swing said planar surface along a relatively long arcuate path about said pivot points compared to the distance covered by said slight rotational movement;

said flexible linkage including a bias member, said bias member storing the energy applied against said planar surface when said planar surface is rotated in a given direction, and subsequently using said stored energy to promote movement of said planar surface in the opposite direction when said planar surface has not been moved a sufficient distance in said given direction to prevent the bias member from moving said planar surface or, after having been moved a sufficient distance in said given direction to prevent the bias member from moving said planar surface, has subsequently been moved a sufficient distance in said opposite direction to allow said bias member to pull said planar surface in said opposite direction;

said rotor equipped with at least one circumferential groove, said groove being capable of accommodating said flexible linkage, the radial distance between the outer surface of a portion of said groove and the center of said rotor exceeding the radial distance between the outer surface of another portion of said groove and the center of said rotor.

6. The access window of claim 5 wherein said rotor is equipped with at least two axially displaced circumferential grooves, each said groove capable of accommodating said flexible linkage, and a region lying adjacent to or between said grooves in which the radial distance between the outer surface of at least a portion of said region and the center of said rotor exceeds the radial distance between the outer surface of at least a portion of each said groove and the center of said rotor.

7. The access window of claim 6 wherein the midpoint of one of said axially displaced circumferential grooves is located about 90° from the midpoint of another one of said axially displaced circumferential grooves.

8. The access window of claim 6 wherein the radial distance between the outer surface of at least a portion of one of said grooves and the center of said rotor exceeds the radial distance between the outer surface of at least a portion of another said groove or grooves and the center of said rotor.

9. An access window for installation in business establishments for providing access between a customer and a sales person comprising:

(a) two pivoting vertically disposed planar surfaces, each said planar surface hinged at a first pivot point and a second pivot point;

(b) a first hinged post and antifriction member attached at said first pivot point;

(c) a second hinged post, antifriction member and rotor attached at said second pivot point;

(d) a flexible linkage interconnecting the rotors such that the flexible linkage causes said rotors to rotate in opposite directions when either rotor is rotated;

(e) a closer bias member connected to said rotors, said closer bias member enabling the closure of said planar surfaces when a relatively slight closing force is applied to said planar surfaces;

wherein a relatively slight rotational movement of either of said planar surfaces from a fixed position causes said flexible linkage and said rotors to swing each of said planar surfaces along a relatively long arcuate path compared to the distance covered by said slight rotational movement;

each said rotor equipped with at least one circumferential groove, each said groove being capable of accommodating the flexible linkage which interconnects the rotors with the closer bias member; said groove having substantially flat surfaces to enable said planar surfaces to attain at least two fixed positions, one position being when said flexible linkage is least stretched and at least one other fixed position in which the friction exerted by a portion of said groove against said flexible linkage more than counteracts the oppositely directed force exerted by said closer bias member allowing said planar surfaces to attain a fixed position in which said flexible linkage has been stretched to a greater degree than it had been stretched when in said least stretched position.

10. The access window described in claim 9 wherein each said rotor is equipped with at least two axially displaced circumferential grooves, each said groove capable of accommodating the flexible linkage which interconnects the rotors with the closer bias member; said grooves having substantially flat surfaces to allow said planar surfaces to attain at least two fixed positions, one position being when said flexible linkage is least stretched and at least one other fixed position in which the friction exerted by the surfaces of said rotors more than counteracts the oppositely directed force exerted by said closer bias member allowing said planar surfaces to attain a fixed position in which said flexible linkage has been stretched to a greater degree than it had been stretched when in said least stretched position.

11. The access window described in claim 9 wherein each said rotor is equipped with at least two axially displaced circumferential grooves, each said groove capable of accommodating the flexible linkage which interconnects the rotors with the closer bias member, and a region lying adjacent to or between said grooves in which the radial distance between the outer surface of at least a portion of said region and the center of said rotor exceeds the radial distance between the outer surface of at least a portion of each of said grooves and the center of said rotor.

12. The access window of claim 11 wherein the midpoint of one of said axially displaced circumferential grooves is located about 90° from the midpoint of another one of said axially displaced circumferential grooves.

13. The access window described in claim 9 wherein each said rotor is equipped with at least two axially displaced circumferential grooves, each said groove capable of accommodating the flexible linkage which interconnects the rotors with the closer bias member, and in which the radial distance between the outer surface of at least a portion of one of said grooves and the center of said rotor exceeds the radial distance between the outer surface of at least a portion of another said groove or grooves and the center of said rotor.

14. An access window for installation in business establishments to provide access between a customer and a sales person comprising:

(a) at least one pivoting planar surface hinged at a minimum of two pivot points;

(b) a rotor member operatively coupled to said planar surface;

(c) an elastic linkage coupling said rotor member to a bias member, said bias member storing the energy applied to move said planar surface from a first fixed position to a second fixed position and subsequently using said stored energy to return said planar surface to said first fixed position from said second fixed position once said planar surface has been moved a sufficient distance toward said first fixed position to allow said bias member to pull said planar surface toward said first fixed position;

said rotor member equipped with at least two substantially flat circumferential grooves, each said groove capable of accommodating said elastic linkage which interconnects said rotor with said bias member.

15. The access window of claim 14 wherein the midpoint of one of said axially displaced circumferential grooves is located about 90° from the midpoint of another one of said axially displaced circumferential grooves.

16. The access window described in claim 14 wherein the radial distance between the outer surface of at least a portion of one of said grooves and the center of said rotor exceeds the radial distance between the outer surface of at least a portion of another said groove or grooves and the center of said rotor.

17. An access window for mounting in a wall or the like which comprises:

(a) a vertically disposed window for swinging between an open position and a closed position by rotation about a substantially vertical pivot axis extending along one side of said window;

(b) a cam mounted on said window co-axially with said window axis to rotate with said window, the cam surface of said cam having an apex and a side surface on each side of said apex;

(c) a flexible linkage extending around said cam surface to transmit motion to said cam, enabling said cam to be rotated, causing said window to be rotated from said open position to said closed position;

(d) said cam oriented relative to said window such that said linkage engages both said side surfaces when said window is open and engages only one of said side surfaces when said window is closed.

18. The access window of claim 17 in which the angle of rotation of said cam between said side surfaces is substantially equal to the angle of rotation of said window between said open and closed positions.

19. The access window of claim 17 in which said side surfaces are substantially flat.

20. The access window of claim 17 in which said cam is a substantially uniform motion cam.

21. The access window of claim 17 in which said cam is a modified uniform motion cam.

22. The access window of claim 17 in which said flexible linkage includes a closer bias member.

* * * * *